United States Patent [19]

Kondo

[11] 4,189,910

[45] Feb. 26, 1980

[54] ELECTRONIC WATCH WITH ALARM MECHANISM

[75] Inventor: Kenichi Kondo, Tokyo, Japan

[73] Assignee: Kabushiki Kaisha Daini Seikosha, Japan

[21] Appl. No.: 734,465

[22] Filed: Oct. 21, 1976

[30] Foreign Application Priority Data

Oct. 28, 1975 [JP] Japan ..... 50-129583

[51] Int. Cl.[2] ..... G04C 21/00

[52] U.S. Cl. ..... 58/38 R; 58/23 R; 58/16.5

[58] Field of Search ..... 58/21.11, 57.5, 16.5, 58/19 R, 38 R, 16 R, 18, 21.13, 21.15, 39, 21.15 S

[56] References Cited

U.S. PATENT DOCUMENTS

| | | | |
|---|---|---|---|
| 3,775,967 | 12/1973 | Spadini | 58/57.5 |
| 3,834,153 | 9/1974 | Yoda | 58/57.5 |
| 3,946,549 | 3/1976 | Cake | 58/57.5 |
| 4,095,410 | 6/1978 | Kaneko | 58/38 R |

*Primary Examiner*—Gene Z. Rubinson

*Assistant Examiner*—Leonard W. Pojunas, Jr.

*Attorney, Agent, or Firm*—Robert E. Burns; Emmanuel J. Lobato; Bruce L. Adams

[57] ABSTRACT

An electronic watch having a time counter for counting a time standard signal to develop a count representative of present time, a recurrent alarm time memory circuit for storing a recurrent alarm time, and a single alarm time memory circuit for storing a once-occurring alarm time. A setting circuit is operable for clearing the contents of the single alarm time memory circuit. A coincidence detecting circuit detects coincidence between the contents of the time counter and the contents of both memory circuits, and develops an output signal when coincidence is detected. Alarm time clearing circuitry responds to the output signal of the coincidence detecting circuit for enabling the setting circuit to clear the single alarm time memory after the once-occurring alarm time has occurred. An alarm circuit is responsive to the output signal of the coincidence detecting circuit for developing an alarm each time the contents of the time counter coincides with the contents of one of the memories.

1 Claim, 2 Drawing Figures

ELECTRONIC WATCH WITH ALARM MECHANISM

BACKGROUND OF THE INVENTION

This invention concerns a multi-alarm electronic watch which is able to set a plurality of alarm setting times and to produce an alarm at every setting time, and which has a function which allows a setting time set in a specified channel to be cleared.

The traditional alarm electronic watches are generally operable to produce an alarm at a first setting time and are operable to produce an alarm again at a second time, setting so that these alarm electronic watches are convienient to use when alarms are needed at the specified same times every day. When only one alarm is needed, the other setting times are cleared by operation of a manual switch. In the multi-alarm electronic watch which is able to set a plurality of setting times, it becomes more convenient to equip it with another channel which can be automatically cleared of setting times set in the specified channel so as not to produce an alarm at coincidence with the above setting time again and to be more able to select any suitable channel if necessary. But such a multi-alarm electronic watch able to reset automatically setting times has not been yet developed.

SUMMARY OF THE INVENTION

An object of this invention is to provide an alarm electronic watch which can automatically clear a set time in a channel after producing an alarm once so as not to produce alarms again by a detecting coincidence signal for a setting time, whether for the single alarm or the recurrent alarm and to reset a memory circuit in the said specified channel only when the coincidence signal is for the single alarm.

SUMMARY OF THE INVENTION

Figure 1:
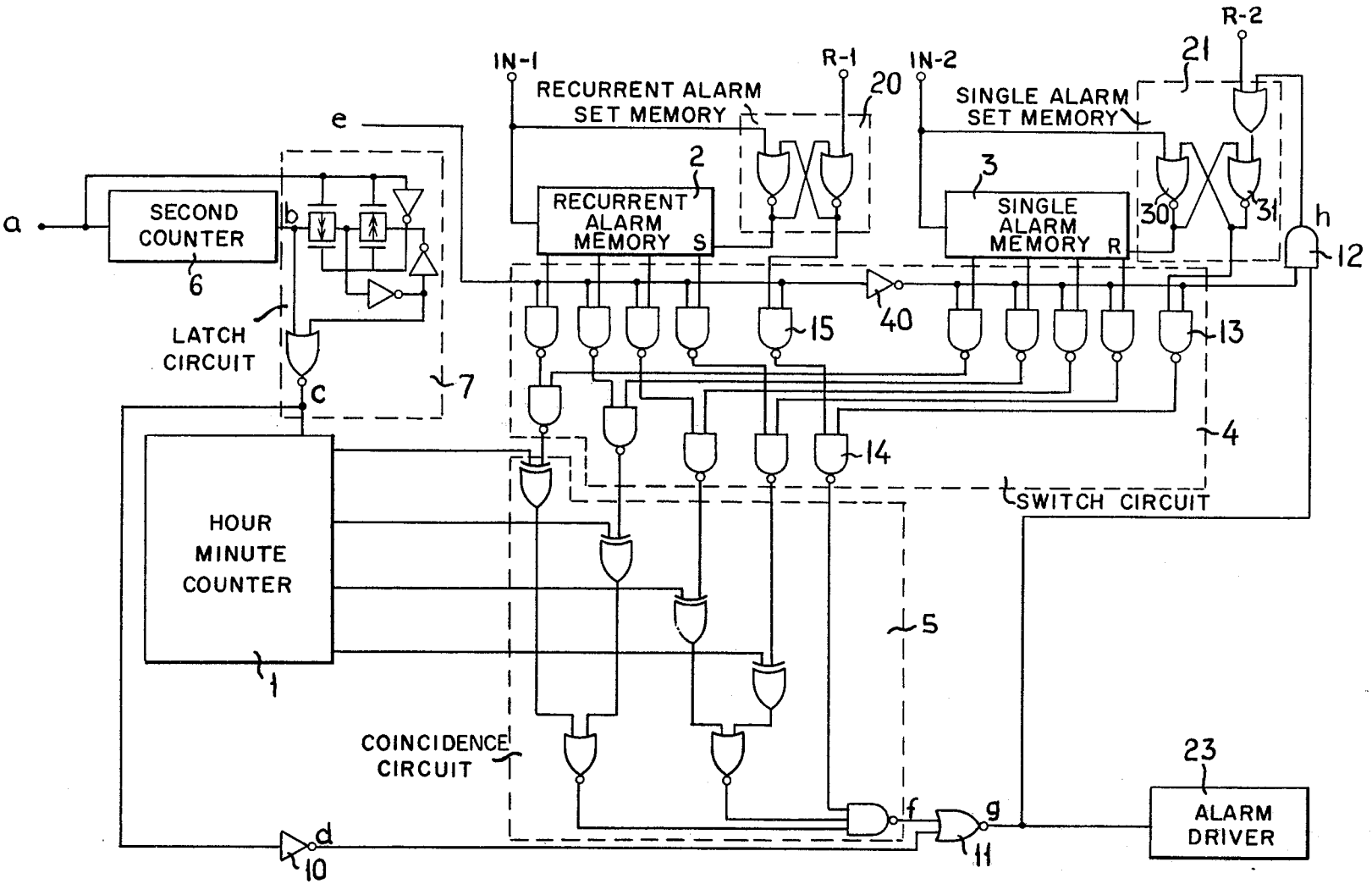
FIG. 1 shows schematic circuit diagram of the multi-alarm electronic timepiece according to the present invention.

The electronic timepiece according to the present invention comprises the structure described below with reference to the FIG. 1: a second counter (6) and hour-minute counter (1) for counting time, a recurrent alarm memory (2), a recurrent alarm set memory (20) for memorizing presence of a set time in the recurrent alarm memory (2), a single alarm memory (3), a single alarm set memory (21), a detecting circuit (12) for detecting coincidence with the single alarm set time, a switch circuit (4) for transmitting the set in the times memories (2) and (3) in a time-division mode, a coincidence circuit (5) for detecting coincidence of the content of the hour-minute counter (1) with the content of the said memories (2) and (3) and an alarm driver (23).

Secondly, the operating mode of this invention is as follows: An oscillating signal produced by a quartz oscillator is divided to a 1-Hz signal "a" and this signal "a" is an input to the second counter (6). The output of the counter (6) becomes a single pulse signal "b" having a one minute cycle and then is shaped into a single pulse signal "c" having 500 milli-second width by a latch circuit (7) and also this signal "c" is an input to the hour-minute counter (1) for counting time. The recurrent alarm memory (2) and the single alarm memory (3) may constitute counters the as same as the hour-minute counter (1), so that these memories can set any desired time therein by inputting a clock signal to the terminals IN-1 and IN-2. At the same time, the input signal to the terminals IN-1 and IN-2 is also an input to the set terminals of the recurrent alarm set memory (20) and the single alarm set memory (21) respectively. Therefore these set memories (20) and (21) may memorize the presence of set time that have been set in the memories (2) and (3) respectively.

Figure 2:
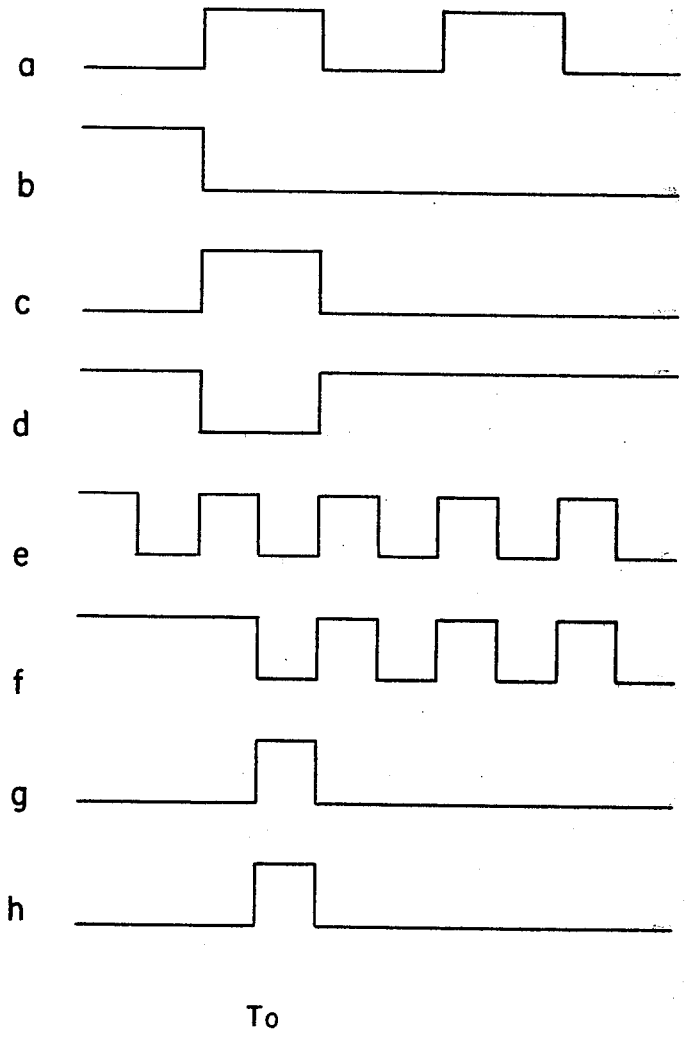
FIG. 2 illustrates waveforms developed during operation of the present ivention.

A signal "e" is a sampling signal for enabling the switch circuit 4 to switch between the output signals of the recurrent alarm memory (2) and the single alarm memory (3) for alternately applying them to the coincidence circuit, and the signal "i.e." is a 2Hz output signal from the dividing circuit. The switch circuit (4) may constitute NAND circuits or transmission gates for switching between and transmitting input signals applied thereto. Then, the output of this switch circuit (4) is an input, together with output of the hour-minute counter (1), to a coincidence circuit (5) for detecting coincidence with the hour-minute counter (1) output. The coincidence circuit (5) is comprised of exclusive OR circuits, NOR circuits and a NAND circuit. Therefore the output of the coincidence circuit (5) turns to a low-level only when coincidence between the hour minute counter and the recurrent or single alarm memory (2) or (3) is detected, but it is always high-level when no coincidence is detected. The wave form of this signal "e" is shown in FIG. 2.

For example, when an alarm setting time in the single alarm memory (3) just coincides with the hour minute counter (1) output at "TO" time, the output of the coincidence circuit (5) changes to a low level from a high level and the coincidence circuit produces a pulse signal "f" which oscillates between the low level and the high level caused by non-coincidence with the recurrent alarm memory (2). Thereupon, the signal "C" is inverted by a inverter (10) to produce a signal "d" and the signal "d" together with the signal "f" are applied to the NOR circuit (11) which produces a pulse signal "g" having a narrow width. This single pulse signal "g" is transmitted to the alarm driver (23) for producing an alarm. Then the alarm trigger signal "g" is an input to a detecting coincidence circuit (12) of the single alarm for detecting coincidence with either the content of the recurrent alarm memory (2) or the single alarm memory (3). The other input of said detecting coincidence circuit (12) for the single alarm, comprising an AND circuit is an inverted signal of the sampling pulse signal "e" developed by an inverter (40). Therefore, the detecting circuit (12) produces a single pulse output signal such as "h" only when detecting coincidence with the content of the single alarm memory (3). Therefore, when there is coincidence with the content of the recurrent alarm memory (2), the detecting circuit (12) does not produce any signal so that the coincidence conditions detected by the coincidence circuit 5 can be easily discriminated.

The signal "h" is a reset input of the single alarm set memory (21). Since the output of a NOR circuit (30) is connected to the reset terminal of the single alarm memory (3), all contents of the memory (3) are cleared at 0 hours 00 minute. On the other hand, the output of a NOR circuit (31) is maintained at a low level. Therefore the output of a reset-detecting circuit (13) in the switch circuit (4) is always at a high level during detection of coincidence with the single alarm memory (3) and is always inverted by a NAND circuit (14) to a low level, so that output "f" of the coincidence circuit (5) turns to a high level and thereafter does not cause an alarm. And if the hour minute counter (1) contact becomes 0hours 0 0 minute again, no alarm is produced because the coincidence signal is not developed due to the reset detecting circuit (13).

To set a new set time in the single alarm memory (3), a clock signal is applied to the input terminal 1N-2 of the single alarm memory (3), and the single alarm set memory (21) maintains a condition allowing a new time to be set. Then, the single alarm memory (3) can produce an alarm when the new setting time is reached. Clearing of the content of the recurrent alarm memory (2) can be accomplished by adding a single pulse signal to the reset terminal R-1 of the reccurrent alarm set memory (20) with a manual switch by hand. And also, resetting of the single alarm by hand can be accomplished by adding a single pulse signal to the reset terminal R-2 with a manual switch.

As discussed above, the setting times in different alarm channels can be detected in time division coincidence detecting mode by using one coincidence circuit in common in spite of having a plurality of channels, and therefore the simplification of circuit can be attained. Moreover, by using one AND circuit for detecting synchronization between the sampling pulse signal and the alarm driving signal, it can be easily and simply determined whether the coincidence is detected with the recurrent alarm or with the single alarm.

Furthermore, this invention has a feature that an alarm is not automatically produced even when 0 hours 00 minute is reached.

I claim as follows:

1. In an electronic watch:

a time counter for counting a repetitive time standard signal, having a repetitive rate representative of an interval of time, to develop a count representative of present time;

a recurrent alarm time memory circuit for storing a recurrent alarm time therein;

a single alarm time memory circuit for storing a once-occurring alarm time and having a reset input;

an R-S flip-flop circuit for clearing the contents of said single alarm time memory circuit, said R-S flip-flop circuit having a first output terminal for developing an enabling signal when set flip-flop is in the set condition, a second output terminal to the reset input of said single alarm time memory for resetting the same when said flip-flop is reset, a set input connected for receiving a single alarm time memory circuit setting signal and a reset input;

a coincidence detecting circuit for detecting coincidence between the contents of said time counter and the contents of said memory circuits and for developing an output signal when coincidence is detected;

switching means for alternately applying the contents of said recurrent alarm time memory and said single alarm time memory to said coincidence detecting circuit to effect comparison between the contents of said time counter and alternate ones of said memories in response to the enabling signal from said R-S flip-flop and for applying the contents of only said recurrent alarm time memory in the absence of the enabling signal;

means responsive to the output signal of said coincidence detecting circuit for resetting said R-S flip-flop circuit to clear said single alarm time memory after the once-occurring alarm time has occurred;

and alarm means responsive to the output signal of said coincidence detecting circuit for developing an alarm signal each time the contents of said time counter coincides with the contents of one of said memories.

* * * * *